US009019180B2

(12) United States Patent
Ahn et al.

(10) Patent No.: US 9,019,180 B2
(45) Date of Patent: Apr. 28, 2015

(54) DISPLAY DEVICE AND DRIVING METHOD THEROF

(71) Applicant: Samsung Display Co., Ltd., Yongin (KR)

(72) Inventors: Hee Sun Ahn, Suwon-si (KR); Oh Jo Kwon, Suwon-si (KR); Kyung Youl Min, Hwaseong-si (KR)

(73) Assignee: Samsung Display Co., Ltd., Yongin (KR)

( * ) Notice: Subject to any disclaimer, the term of this patent is extended or adjusted under 35 U.S.C. 154(b) by 0 days.

(21) Appl. No.: 14/161,364

(22) Filed: Jan. 22, 2014

(65) Prior Publication Data

US 2015/0070339 A1 Mar. 12, 2015

(30) Foreign Application Priority Data

Sep. 9, 2013 (KR) ..... 10-2013-0107996

(51) Int. Cl.
*G09G 3/30* (2006.01)
*G09G 3/32* (2006.01)

(52) U.S. Cl.
CPC ..... *G09G 3/3283* (2013.01)

(58) Field of Classification Search
CPC ..... G09G 2300/0417; G09G 2300/0426; G09G 2300/0852; G09G 2310/0205; G09G 2310/0235; G09G 2310/0256; G09G 2310/0262; G09G 2310/0272; G09G 2310/0286; G09G 2320/0295; G09G 2320/0626; G09G 2320/0666; H01L 2924/0002; H01L 27/3276; H01L 27/3211; H01L 27/3244; H01L 2924/00; H01L 27/1214; H01L 27/3213; H01L 27/3223; H01L 27/3248; H01L 27/3262; H01L 27/3265; H01L 27/3288; H01L 2227/323
USPC ..... 345/76–84, 690, 204, 211
See application file for complete search history.

(56) References Cited

U.S. PATENT DOCUMENTS

| | | | | |
|---|---|---|---|---|
| 6,956,417 | B2 | 10/2005 | Bernstein et al. | |
| 7,280,405 | B2 | 10/2007 | Sarig | |
| 7,476,836 | B2 | 1/2009 | Boemler | |
| 7,652,644 | B2 * | 1/2010 | Lee et al. | 345/75.2 |
| 7,816,936 | B2 | 10/2010 | Ito | |
| 8,040,167 | B1 | 10/2011 | Lin et al. | |
| 8,093,952 | B2 | 1/2012 | Behzad et al. | |
| 8,154,631 | B2 | 4/2012 | Herrmann et al. | |
| 2003/0122813 | A1 * | 7/2003 | Ishizuki et al. | 345/211 |
| 2006/0290621 | A1 * | 12/2006 | Son et al. | 345/82 |
| 2009/0309818 | A1 * | 12/2009 | Kim | 345/77 |
| 2011/0140767 | A1 | 6/2011 | Lin | |

FOREIGN PATENT DOCUMENTS

| | | |
|---|---|---|
| KR | 101010916 | 1/2011 |

* cited by examiner

*Primary Examiner* — Duc Dinh
(74) *Attorney, Agent, or Firm* — H.C. Park & Associates, PLC

(57) ABSTRACT

A display device including pixels; a leakage current compensator connected to at least one of data lines connected to the pixels; and an integrator connected to the leakage current compensator. The leakage current compensator is configured to store a voltage that corresponds to a leakage current that flows to the at least one data line, and to flow the leakage current to ground from the at least one data line according to a voltage that corresponds to the leakage current. The integrator is configured to receive a pixel current generated by subtracting the leakage current from a measurement current that flows to the at least one data line, and to output a difference value between a pixel voltage that corresponds to the pixel current and a reference voltage.

19 Claims, 9 Drawing Sheets

DISPLAY DEVICE AND DRIVING METHOD THEROF

CROSS-REFERENCE TO RELATED APPLICATION

This application claims priority from and the benefit of Korean Patent Application No. 10-2013-0107996, filed on Sep. 9, 2013, which is hereby incorporated by reference for all purposes as if fully set forth herein.

BACKGROUND

1. Field

Exemplary embodiments of the present invention relate to a display device and a driving method thereof. More particularly, exemplary embodiments of the present invention relate to a display device for measuring an accurate pixel current by compensating a leakage current, and a driving method thereof.

2. Discussion of the Background

An organic light emitting diode (OLED) display uses an OLED for controlling luminance by controlling a current or voltage. The OLED includes an anode layer and a cathode layer for forming an electric field, and an organic light emitting material emits light by controlling the electric field.

Generally, the organic light emitting diode display is classified, according to the driving method, as a passive matrix OLED (PMOLED) or an active matrix OLED (AMOLED). Of these, in view of resolution, contrast, and operation speed, the AMOLED is mainly used. The AMOLED is selectively turned on for every unit pixel.

An organic light emitting diode tends to degrade with use over time, resulting in an emission amount controlled by the pixel current of the degraded organic light emitting diode which may be different from the emission amount at an initial stage. Accordingly, image quality of the organic light emitting device is degraded.

Various methods for compensating the degradation of the organic light emitting diode have been developed. One of them is a method for measuring a pixel current to detect a degree of degradation of the organic light emitting diode. When the pixel current is measured, a leakage current is included in the measured pixel current. When the leakage current is compensated in the measured pixel current, an accurate pixel current is measured, but it is not easy to accurately measure the leakage current.

Further, organic light emitting devices have recently increased in width, thereby resulting in an increase in resistance and capacitance components, and an increase in the time for measuring the pixel current. As a result, there is also an increase in the difficulty in measuring the pixel current and accurately detecting the degradation of the organic light emitting diode.

The above information disclosed in this Background section is only for enhancement of understanding of the background of the invention and, therefore, it may contain information that does not constitute the prior art.

SUMMARY

Exemplary embodiments of the present invention provide a display device for accurately detecting degradation of a pixel by compensating for a leakage current and accurately measuring pixel current, and a driving method thereof.

Additional aspects will be set forth in part in the description which follows and, in part will be apparent from the description, or may be learned by practice of the invention.

An exemplary embodiment of the present invention discloses a display device including: pixels; a leakage current compensator connected to at least one of a plurality of data lines connected to the pixels; and an integrator connected to the leakage current compensator. The leakage current compensator is configured to store a voltage that corresponds to a leakage current that flows to the at least one data line, and to flow the leakage current to ground from the at least one data line according to a voltage that corresponds to the leakage current. The integrator is configured to receive a pixel current generated by subtracting the leakage current from a measurement current that flows to the at least one data line, and to output a difference value between a pixel voltage that corresponds to the pixel current and a reference voltage.

An exemplary embodiment of the present invention also discloses a method for driving a display device, including: storing a voltage that corresponds to a leakage current that flows to a data line connected to a pixel; flowing the leakage current to ground from the data line according to a voltage that corresponds to the leakage current; flowing a measurement current to the data line; receiving a pixel current generated by subtracting the leakage current from the measurement current; and outputting a difference value between a pixel voltage that corresponds to the pixel current and a reference voltage.

An exemplary embodiment of the present invention also discloses a method for driving a display device, including: outputting a difference value between a pixel voltage that corresponds to a pixel current generated by subtracting a leakage current of an even data line from a measurement current that flows to the even data line and a reference voltage when a voltage that corresponds to a leakage current that flows to an odd data line is stored; and outputting a difference value between a pixel voltage that corresponds to a pixel current generated by subtracting a leakage current of the odd data line from a measurement current that flows to the odd data line and the reference voltage when a voltage that corresponds to a leakage current of the even data line is stored.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the principles of the invention.

DETAILED DESCRIPTION OF THE ILLUSTRATED EMBODIMENTS

Figure 1:
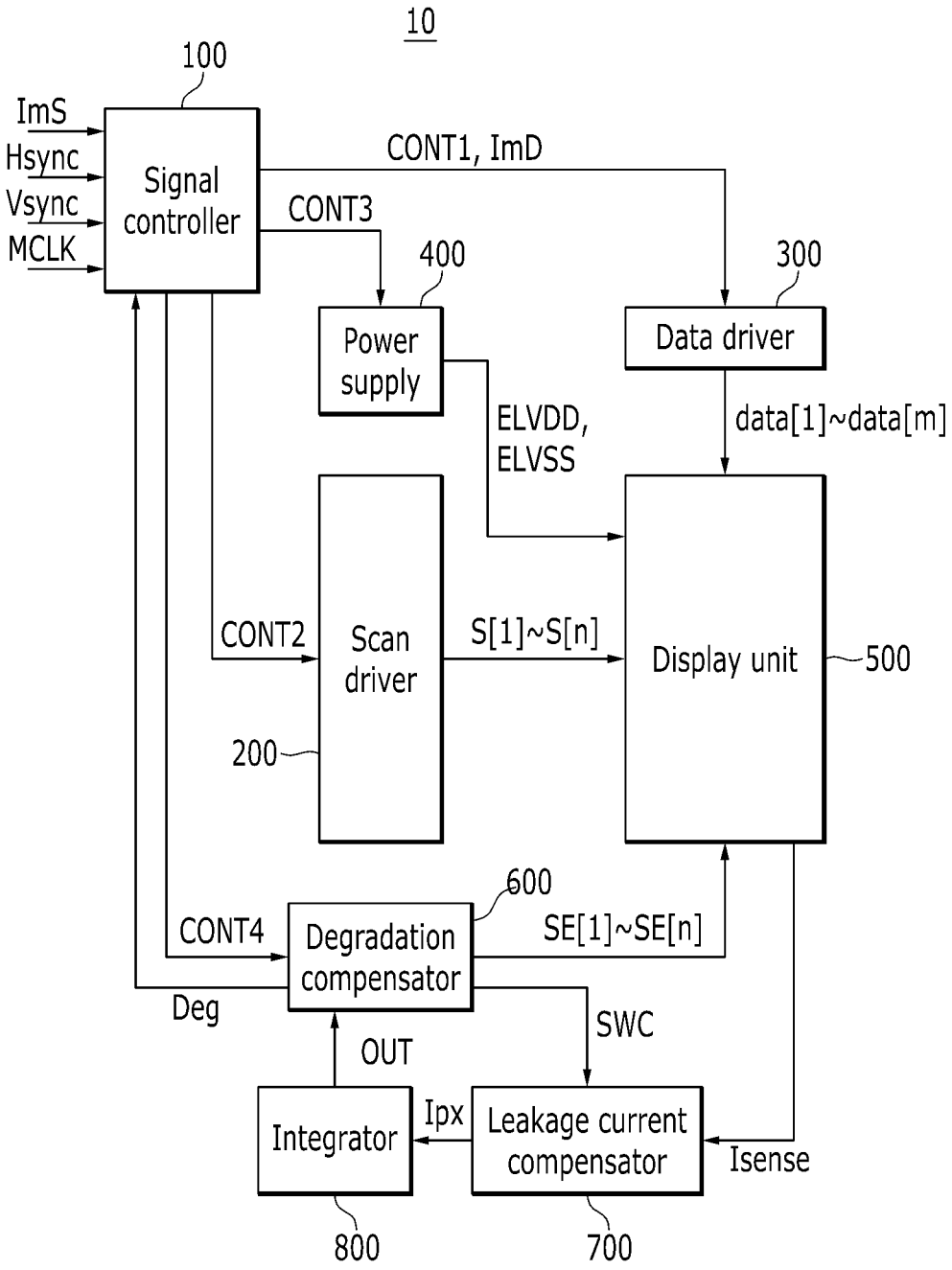
FIG. 1 shows a block diagram of a display device according to an exemplary embodiment of the present invention.

The present invention will be described more fully hereinafter with reference to the accompanying drawings, in which exemplary embodiments of the invention are shown. This invention may, however, be embodied in many different forms and should not be construed as limited to the exemplary embodiments set forth herein. Rather, these exemplary embodiments are provided so that this disclosure is thorough, and will fully convey the scope of the invention to those skilled in the art. In the drawings, the size and relative sizes of elements may be exaggerated for clarity. Like reference numerals in the drawings denote like elements.

In addition, elements will be representatively explained in the first exemplary embodiment using reference numerals, and in the remaining embodiments, different elements from the first exemplary embodiment will be explained. Portions having no relation with the description will be omitted in order to explicitly explain the present invention, and the same reference numerals will be used for the same or similar elements throughout the specification.

Throughout this specification and the claims that follow, it will be understood that when an element is referred to as being "coupled" to another element, the element may be "directly coupled" to the other element or "electrically coupled" to the other element through a third element. In contrast, when an element is referred to as being "directly coupled to" another element, there are no intervening elements present. It will be understood that for the purposes of this disclosure, "at least one of X, Y, and Z" can be construed as X only, Y only, Z only, or any combination of two or more items X, Y, and Z (e.g., XYZ, XYY, YZ, ZZ). In addition, unless explicitly described to the contrary, the word "comprise" and variations such as "comprises" or "comprising" will be understood to imply the inclusion of stated elements but not the exclusion of any other elements.

FIG. 1 shows a block diagram of a display device according to an exemplary embodiment of the present invention.

Referring to FIG. 1, the display device 10 includes a signal controller 100, a scan driver 200, a data driver 300, a power supply 400, a display unit 500, a degradation compensator 600, a leakage current compensator 700, and an integrator 800.

The signal controller 100 receives an image signal (ImS) and a synchronizing signal from an external device. The image signal (ImS) includes luminance information for a plurality of pixels. The luminance has a preselected number (e.g., $1024=2^{10}$, $256=2^{8}$, or $64=2^{6}$) of grays. The synchronizing signal includes a horizontal synchronization signal (Hsync), a vertical synchronization signal (Vsync), and a main clock signal (MCLK).

The signal controller 100 generates first to fourth drive control signals (CONT1 to CONT4) and image data (ImD) according to the image signal (ImS), the horizontal synchronizing signal (Hsync), the vertical synchronization signal (Vsync), and the main clock signal (MCLK). The signal controller 100 distinguishes the image signal (ImS) for each frame according to the vertical synchronization signal (Vsync) and distinguishes the image signal (ImS) for each scan line according to the horizontal synchronization signal (Hsync) to generate the image data (ImD). The signal controller 100 transmits the image data (ImD) together with a first drive control signal (CONT1) to the data driver 300.

The display unit 500 includes a display area having a plurality of pixels. On the display unit 500, scan lines that are substantially extended in a row direction and are substantially in parallel with each other, data lines that are substantially extended in a column direction and are substantially in parallel with each other, power lines, and sense lines are formed to be connected to the pixels. The pixels are substantially arranged in a matrix.

The scan driver 200 is connected to the scan lines and generates scanning signals (S[1]-S[n]) according to the second drive control signal (CONT2). The scan driver 200 can sequentially apply the scanning signals (S[1]-S[n]) with a gate-on voltage to the scan lines.

The data driver 300 is connected to the data lines, samples and holds the input image data (ImD) according to the first drive control signal (CONT1), and transmits data signals (data[1]-data[m]) to the data lines. The data driver 300 applies data signals (data[1]-data[m]) with a preselected voltage range to the data lines corresponding to the scanning signals (S[1]-S[n]) with a gate-on voltage.

The power supply 400 determines levels of a first power voltage (ELVDD) and a second power voltage (ELVSS) according to the third drive control signal (CONT3), and supplies the same to power lines connected to the pixels. The first power voltage (ELVDD) and the second power voltage (ELVSS) provide a drive current of the pixel.

The degradation compensator 600 is connected to the sense lines and generates sense signals (SE[1]-SE[n]) according to a fourth drive control signal (CONT4). The degradation compensator 600 can sequentially apply the sense signal (SE[1]-SE[n]) with a gate-on voltage. The degradation compensator 600 applies a switching control signal (SWC) to the leakage current compensator 700 according to the fourth drive control signal (CONT4).

The leakage current compensator 700 is connected to the data lines, and measures a measurement current (Isense) flowing to the data lines. The leakage current compensator 700 can be selectively connected to at least one of the data lines according to the switching control signal (SWC). As described later in more detail with reference to FIG. 4, the leakage current compensator 700 stores a voltage that corresponds to a leakage current (I_leak) flowing to the data lines, and flows the leakage current (I_leak) to ground from the data line according to that voltage to compensate the leakage current (I_leak) flowing to the data lines. The leakage current compensator 700 transmits a pixel current (Ipx) generated by subtracting the leakage current (I_leak) from the measurement current (Isense) to the integrator 800.

The integrator 800 receives the pixel current (Ipx). The integrator 800 outputs a difference value (OUT) between a pixel voltage that corresponds to the pixel current (Ipx) and a reference voltage (Vset). The integrator 800 transmits the difference value (OUT) to the degradation compensator 600.

The degradation compensator 600 detects a degree of degradation of the pixel according to the difference value (OUT), and transmits degradation information (Deg) indicating the degree of degradation of the pixel to the signal controller 100. The signal controller 100 then applies degradation information (Deg) of the pixel to generate the image data (ImD).

The respective driving devices (100, 200, 300, 400, 600, 700, and 800) can be directly mounted as at least one IC chip on the display unit 500, mounted on a flexible printed circuit film, attached as a tape carrier package (TCP) to the display unit 500, mounted to an additional printed circuit board (PCB), or integrated with the display unit 500.

Figure 2:
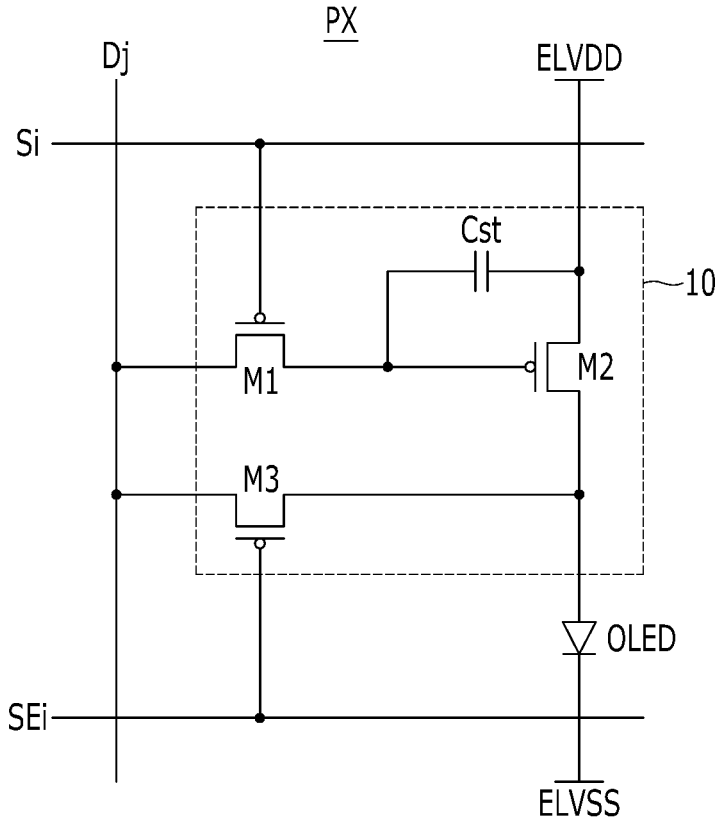
FIG. 2 shows a circuit diagram of a pixel according to an exemplary embodiment of the present invention.

FIG. 2 shows a circuit diagram of a pixel according to an exemplary embodiment of the present invention.

Referring to FIG. 2, a pixel (PX) is provided on an i-th row and a j-th column ($1 \leq i \leq n$, $1 \leq j \leq m$) from among pixels included in the display device 10.

The pixel (PX) includes an organic light emitting diode (OLED) and a pixel circuit 10 for controlling the organic light emitting diode (OLED). The pixel circuit 10 includes a switching transistor (M1), a driving transistor (M2), a sense transistor (M3), and a storage capacitor (Cst).

The switching transistor (M1) includes a gate electrode connected to a scan line (Si), a first terminal connected to a data line (Dj), and a second terminal connected to a gate electrode of the driving transistor (M2).

The driving transistor (M2) includes a gate electrode connected to a second terminal of the switching transistor (M1), a first terminal connected to the first power voltage (ELVDD), and a second terminal connected to the organic light emitting diode (OLED).

The sense transistor (M3) includes a gate electrode connected to a sense line (SEi), a first terminal connected to the second terminal of the driving transistor (M2), and a second terminal connected to the data line (Dj).

The storage capacitor (Cst) includes a first terminal connected to the gate electrode of the driving transistor (M2) and a second terminal connected to the first power voltage (ELVDD). The storage capacitor (Cst) charges a data voltage applied to the gate electrode of the driving transistor (M2), and it maintains that charged data voltage when the switching transistor (M1) is turned off.

The organic light emitting diode (OLED) includes an anode connected to the second terminal of the driving transistor (M2) and a cathode connected to the second power voltage (ELVSS). The organic light emitting diode (OLED) includes an organic emission layer (not shown) for emitting light of one of the primary colors. The three primary colors may be red, green, and blue, and the desired color is expressed by a spatial or temporal sum of the three primary colors.

The organic emission layer is made of a low molecular weight organic material or a high molecular weight organic material, such as poly(3,4-ethylenedioxythiophene) (PEDOT). Also, the organic emission layer can be formed to have multiple layers, including at least one of an emission layer, a hole injection layer (HIL), a hole transport layer (HTL), an electron transport layer (ETL), and an electron injection layer (EIL). When all layers are included, the hole injection layer (HIL) is disposed on the pixel electrode, an anode, and then the hole transport layer (HTL), the emission layer, the electron transport layer (ETL), and the electron injection layer (EIL) are sequentially formed thereon.

The organic emission layer may include a red organic emission layer to light-emit red, a green organic emission layer to light-emit green, and a blue organic emission layer to light-emit blue, wherein the red organic emission layer, the green organic emission layer, and the blue organic emission layer may be formed in a red pixel, a green pixel, and a blue pixel, respectively, to realize color images.

Further, the organic emission layer can be stacked together with the red organic emission layer, the green organic emission layer, and the blue organic emission layer in the red pixel, the green pixel, and the blue pixel to form a red color filter, a green color filter, and a blue color filter for each pixel, and to implement color images. As another example, a white organic emission layer to light-emit white can be formed in each of the red pixel, the green pixel, and the blue pixel to form the red color filter, the green color filter, and the blue color filter for each pixel, respectively, and to implement the color images. When the color image is implemented using the white organic emission layer and the color filter, the red organic emission layer, the green organic emission layer, and the blue organic emission layer are not required to use a deposition mask to be deposited for each of the red pixel, the green pixel, and the blue pixel.

The white organic emission layer described in another example may be formed of one organic emission layer, and may include a configuration to light-emit the white color by using the plurality of organic emission layers. For example, a configuration to light-emit the white color by combining at least one yellow organic emission layer and at least one blue organic emission layer, a configuration to light-emit the white by combining at least one cyan organic emission layer and at least one red organic emission layer, and a configuration to light-emit the white by combining at least one magenta organic emission layer and at least one green organic emission layer, may also be included.

Referring again to FIG. 2, the switching transistor (M1), the driving transistor (M2), and the sense transistor (M3) can be p-channel electric field effect transistors. In this instance, the gate-on voltage for turning on the switching transistor (M1), the driving transistor (M2), and the sense transistor (M3) is a low level voltage, and a gate-off voltage for turning the same off is a high level voltage.

Here, the p-channel electric field effect transistors are shown, and at least one of the switching transistor (M1), the driving transistor (M2), and the sense transistor (M3) can be an n-channel electric field effect transistor. In this instance, the gate-on voltage for turning on the n-channel electric field effect transistor is a high level voltage, and the gate-off voltage for turning it off is a low level voltage.

When the scanning signal (S[i]) with a gate-on voltage is applied to the scan line (Si), the switching transistor (M1) is turned on, and the data signal applied to the data line (Dj) is applied to the first terminal of the storage capacitor (Cst) through the turned-on switching transistor (M1) to thus charge the storage capacitor (Cst). The driving transistor (M2) controls a pixel current flowing to the organic light emitting diode (OLED) from the first power voltage (ELVDD) corresponding to the voltage charged in the storage capacitor (Cst). The organic light emitting diode (OLED) emits light that corresponds to the amount of the pixel current that flows through the driving transistor (M2). By the way, during general driving by which the display device 10 displays an image, a sense signal (SE[i]) with a gate-off voltage is applied to the sense line (SEi) and the sense transistor (M3) is turned off.

When the display device 10 performs compensation driving for measuring pixel currents of the respective pixels (PX) in order to compensate the degradation of the pixels (PX), the sense signal (SE[i]) with a gate-on voltage is applied to the sense line (SEi) and the sense transistor (M3) is turned on. The pixel current flows to the data line (Dj) through the turned-on sense transistor (M3).

Figure 3:
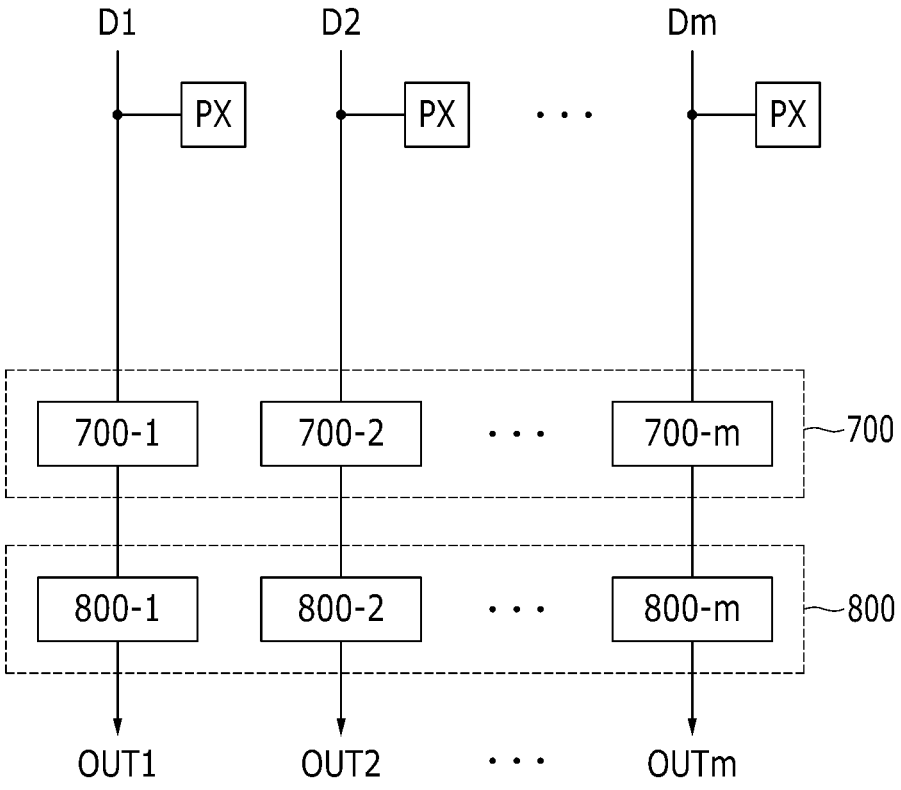
FIG. 3 shows a block diagram of a leakage current compensator and an integrator according to an exemplary embodiment of the present invention.
Figure 4:
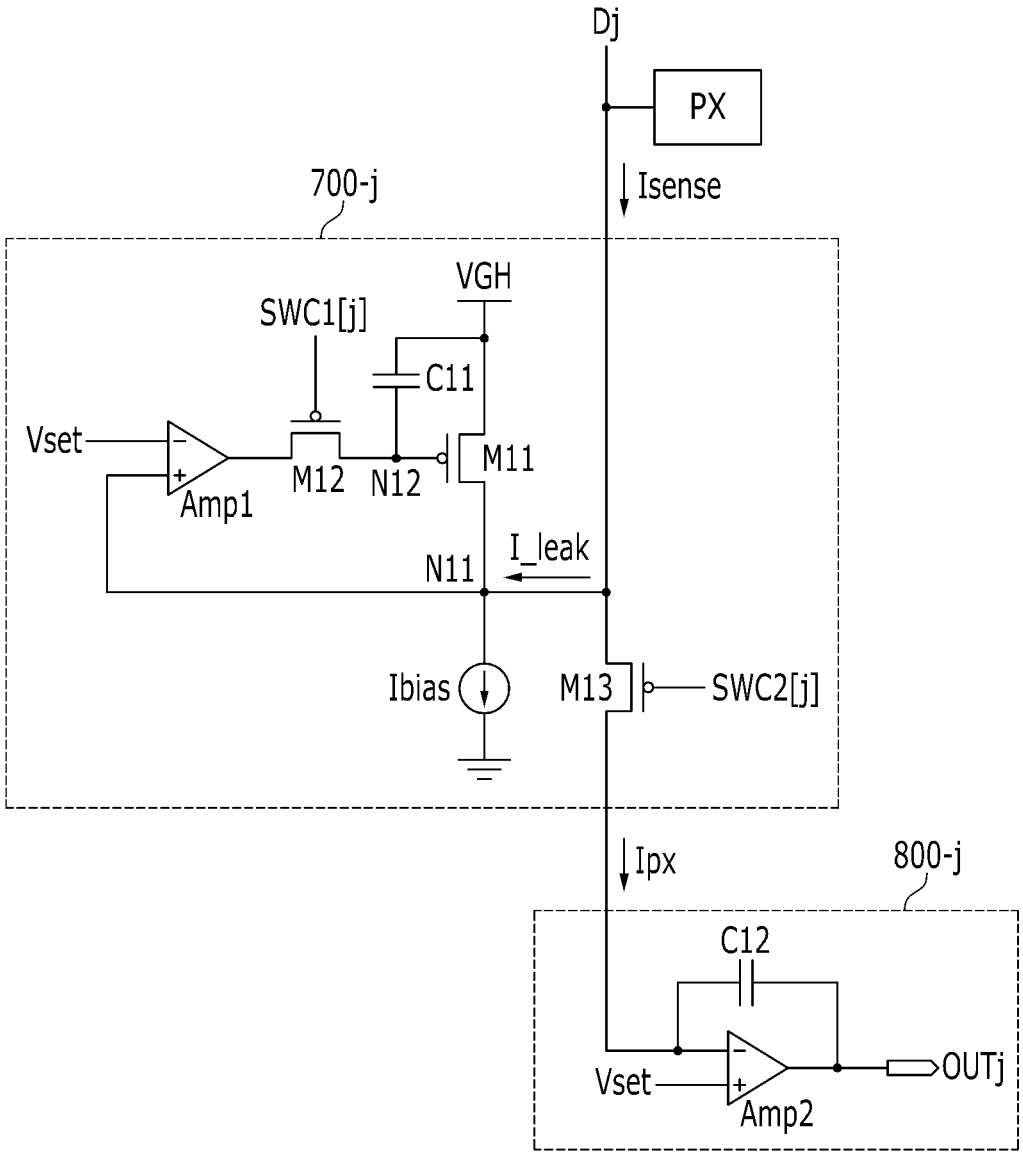
FIG. 4 shows a circuit diagram of a leakage current compensator and an integrator according to an exemplary embodiment of the present invention.

A detailed configuration of the leakage current compensator 700 and the integrator 800 will now be described, in which FIG. 3 shows a block diagram of a leakage current compensator and an integrator according to an exemplary embodiment of the present invention, and FIG. 4 shows a circuit diagram of the leakage current compensator and integrator of FIG. 3.

The leakage current compensator 700 includes leakage current compensation circuits (700-1, 700-2, . . . , **700-*m***)

connected to the data lines (D1-Dm). The integrator 800 includes integration circuits (800-1, 800-2, . . . , **800-*m*) connected to the data lines (D1-Dm). The leakage current compensation circuits (700-1, 700-2, . . . , 700-*m*) are connected to of the integration circuits (800-1, 800-2, . . . , 800-*m***).

A configuration of a leakage current compensation circuit (**700-*j*) connected to a j-th data line (Dj) and an integration circuit 800-*j* connected thereto will now be described ($1 \leq j \leq m$) with reference to FIG. 4**.

The leakage current compensation circuit (**700-*j*) includes a first transistor (M11), a second transistor (M12), a third transistor (M13), a first capacitor (C11), a first differential amplifier (Amp1**), and a bias circuit (Ibias).

The first transistor (M11) includes a gate electrode connected to a second node (N12), a first electrode connected to a high level voltage (VGH), and a second electrode connected to a first node (N11). The first node (N11) is connected to the data line (Dj).

The second transistor (M12) includes a gate electrode for receiving a first switching control signal (SWC1[*j*]), a first electrode connected to an output terminal of the first differential amplifier (Amp1), and a second electrode connected to the second node (N12).

The third transistor (M13) includes a gate electrode for receiving a second switching control signal (SWC2[*j*]), a first electrode connected to the first node (N11), and a second electrode connected to the integration circuit (**800-*j***).

The first capacitor (C11) includes a first electrode connected to the high level voltage (VGH) and a second electrode connected to the second node (N12).

The first differential amplifier (Amp1) includes a first input terminal (+) connected to the first node (N11), a second input terminal (−) for receiving a reference voltage (Vset), and an output terminal connected to the first electrode of the second transistor (M12).

The bias circuit (Ibias) is connected between the first node (N11) and the ground, and flows an amount of current determined by the first node (N11) to the ground.

The integration circuit (**800-*j*) includes a second differential amplifier (Amp2) and a second capacitor (C12**).

The second differential amplifier (Amp2) includes a first input terminal (+) for receiving a reference voltage (Vset), a second input terminal (−) connected to a second electrode of the third transistor (M13), and an output terminal for outputting a difference value (OUTj) between the pixel voltage and the reference voltage (Vset).

The second capacitor (C12) includes a first electrode connected to a second input terminal (−) of the second differential amplifier (Amp2), and a second electrode connected to the output terminal of the second differential amplifier (Amp2).

An operation of the leakage current compensation circuit **700-*j* and the integration circuit 800-*j*** will now be described.

During a first period for sensing and storing the leakage current, the first switching control signal (SWC1[*j*]) is applied as a gate-on voltage, and the second switching control signal (SWC2[*j*]) is applied as a gate-off voltage. In this instance, no data signal is applied to the data line (Dj). The sense signal (SE[i]) with a gate-off voltage can be applied to the gate electrode of the sense transistor (M3) included of the pixels (PX) connected to the data line (Dj). The second transistor (M12) is turned on by the first switching control signal (SWC1[*j*]) with a gate-on voltage. When the second transistor (M12) is turned on, a voltage at the second node (N12) becomes a voltage for flowing the leakage current (I_leak) of the data line (Dj) to the leakage current compensation circuit (**700-*j*). The voltage at the second node (N12) is stored in the first capacitor (C11**).

For example, assume that the bias circuit (Ibias) flows a constant current of 10 uA to the ground from the first node (N11), and that the leakage current (I_leak) is 1 uA. In this instance, the voltage at the second node (N12) represents a voltage for the first transistor (M11) to flow a current of 9 uA to the first node (N11) from the high level voltage (VGH). Because the bias circuit (Ibias) flows a current of 10 uA to ground from the first node (N11), and the first transistor (M11) flows a current of 9 uA to the first node (N11), the current of 1 uA, corresponding to the leakage current (I_leak), flows to the first node (N11) on the data line (Dj).

When a current amount that is greater than the current amount flowing to the ground from the first node (N11) through the bias circuit (Ibias) flows to the first node (N11), the voltage at the first node (N11) is increased. When the voltage at the first node (N11) is increased, a voltage that is input to the first input terminal (+) of the first differential amplifier (Amp1) is increased, and a voltage that is output to the second node (N12) of the first differential amplifier (Amp1) is increased. When the voltage at the second node (N12) is increased, the first transistor (M11) reduces the current amount that flows to the first node (N11) from the high level voltage (VGH) corresponding to the increased voltage, thereby resulting in an increase in the current amount flowing to the first node (N11).

On the contrary, when a current amount that is less than the current amount flowing to ground from the first node (N11) through the bias circuit (Ibias) flows to the first node (N11), the voltage at the first node (N11) is reduced. When the voltage at the first node (N11) is reduced, the voltage that is input to the first input terminal (+) of the first differential amplifier (Amp1) is reduced, and the voltage that is output to the second node (N12) from the first differential amplifier (Amp1) is reduced. When the voltage at the second node (N12) is reduced, the first transistor (M11) increases the current amount that flows to the first node (N11) from the high level voltage (VGH) corresponding to the reduced voltage. As a result, the current amount flowing to the first node (N11) is increased. As a result, the current amount generated by subtracting the leakage current (I_leak) from the current amount that flows to the ground from the first node (N11) through the bias circuit (Ibias) flows to the first node (N11) through the first transistor (M11).

During a second period for measuring degradation of pixels after the first period, the first switching control signal (SWC1[*j*]) is applied as a gate-off voltage and the second switching control signal (SWC2[*j*]) is applied as a gate-on voltage. As the first switching control signal (SWC1[*j*]) is applied as a gate-off voltage, the second transistor (M12) is turned off and the voltage at the second node (N12) is maintained as the voltage stored in the first capacitor (C11). In this instance, the sense signal (SEW) with a gate-on voltage is applied to the gate electrode of the sense transistor (M3) included in the pixel (PX) shown in FIG. 2, of which degradation will be measured from among the pixels (PX) connected to the data line (Dj). Here, a data signal with a preselected voltage is applied to the gate electrode of the driving transistor (M2) included in the pixel (PX). As the sense transistor (M3) of the pixel (PX) is turned on, a pixel current (Ipx) flowing to the organic light emitting diode (OLED) through the driving transistor (M2) is applied to the data line (Dj) through the sense transistor (M3). A measurement current (Isense), which is a summation of the pixel current (Ipx) and the leakage current (Ileak), applied to the data line (Dj).

Because the bias circuit (Ibias) flows a preseslected current amount to the ground from the first node (N11), and the first transistor (M11) flows a current amount generated by subtracting the leakage current (I_leak) from the current amount that flows to the ground from the first node (N11) through the bias circuit (Ibias) to the first node (N11), the current that corresponds to the leakage current (I_leak) flows to the first node (N11) from the data line (Dj). As a result, the current generated by subtracting the leakage current (I_leak) from the measurement current (Isense), that is, the pixel current (Ipx), flows to the integration circuit (800-*j*).

The second capacitor (C12) is charged with the pixel current (Ipx), and the second capacitor (C12) is charged with the pixel voltage that corresponds to the pixel current (Ipx). That is, the pixel voltage that corresponds to the pixel current (Ipx) is input to the second input terminal (−) of the second differential amplifier (Amp2), and a difference value (OUTj) between the reference voltage (Vset) and the pixel voltage is output. The pixel voltage corresponds to the data signal of a preselected voltage, and becomes different when the pixel (PX) is degraded. Therefore, a degree of degradation of the pixel (PX) can be detected by measuring the difference value (OUTj) between the reference voltage (Vset) and the pixel voltage.

The degradation compensator 600 sequentially applies the sense signals (SEW-SE[n]) with a gate-on voltage to of the sense lines to detect degrees of degradation of the pixels.

Figure 5:
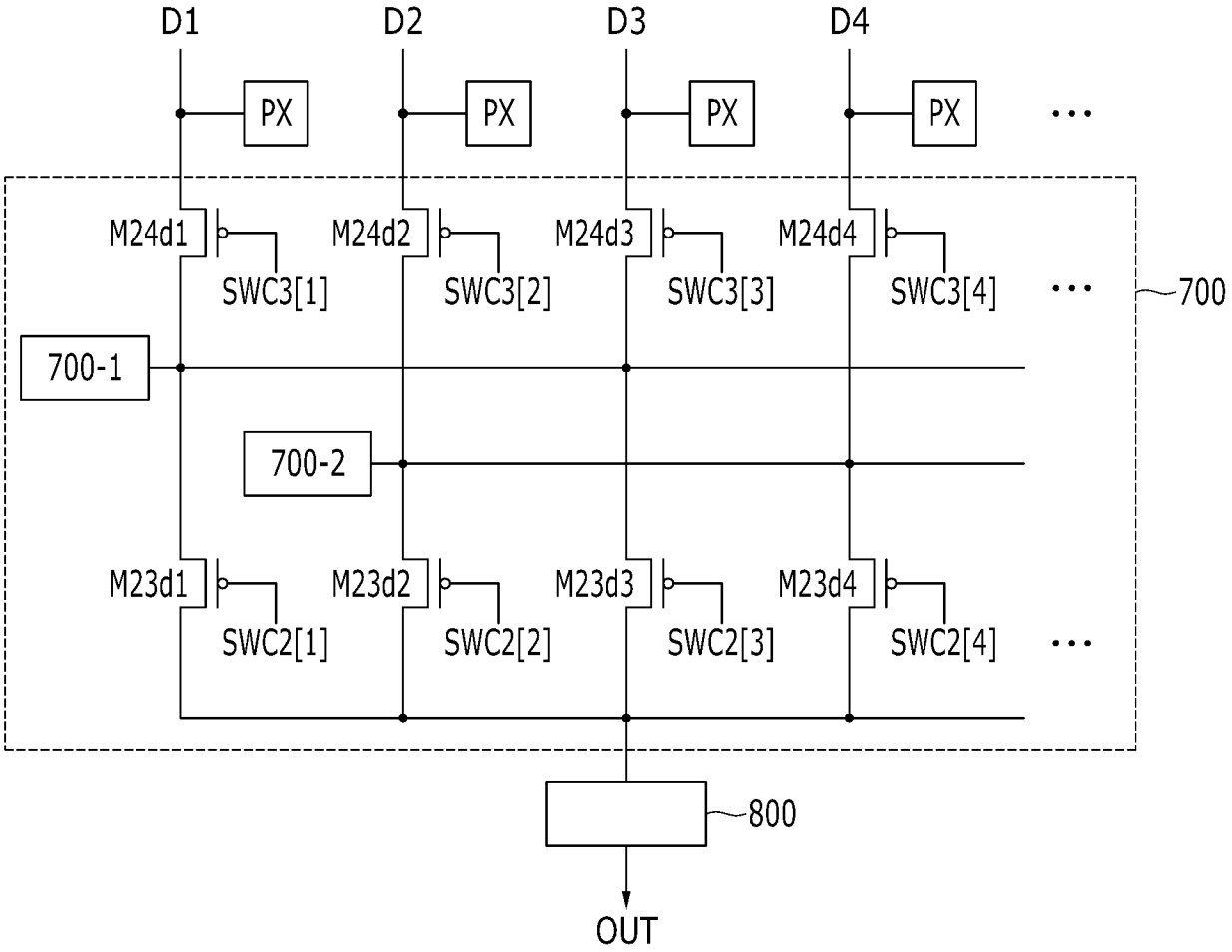
FIG. 5 shows a block diagram of a leakage current compensator and an integrator according to an exemplary embodiment of the present invention.
Figure 6:
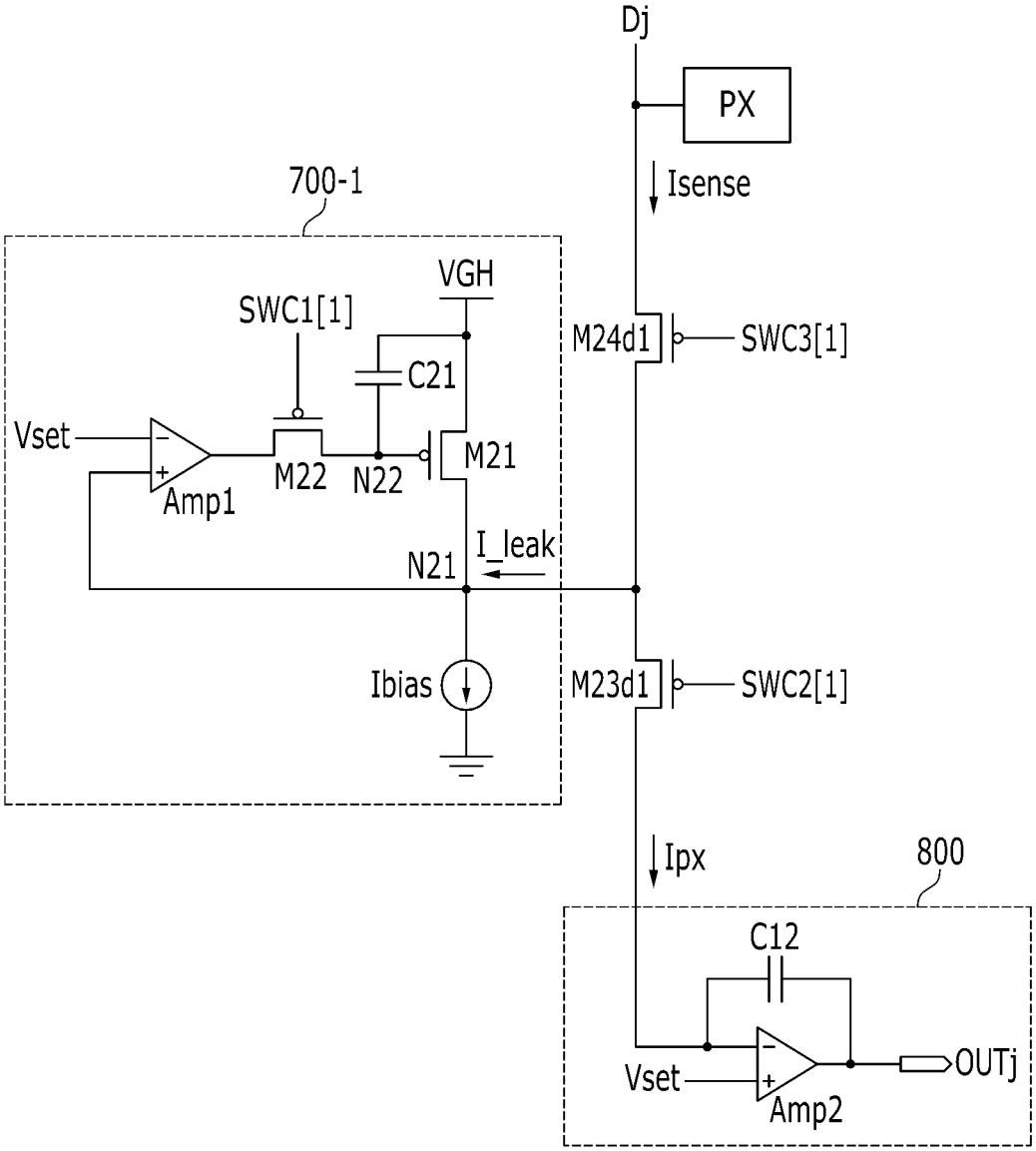
FIG. 6 shows a circuit diagram of a leakage current compensator and an integrator according to an exemplary embodiment of the present invention.
Figure 7:
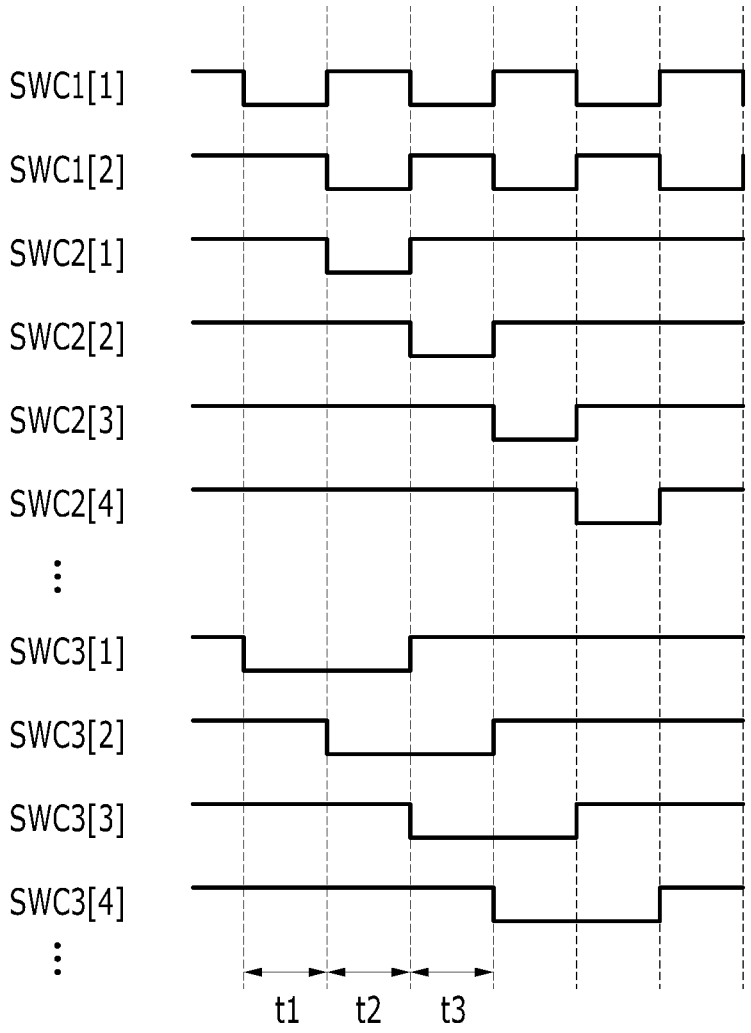
FIG. 7 shows a timing diagram of an operation of a leakage current compensator and an integrator of FIG. 5.

FIG. 5 shows a block diagram of a leakage current compensator and an integrator according to an exemplary embodiment of the present invention, and FIG. 6 shows a circuit diagram of the leakage current compensator and the integrator of FIG. 5. FIG. 7 shows a timing diagram of an operation of the leakage current compensator and the integrator of FIG. 5.

Referring to FIG. 5 to FIG. 7, the leakage current compensator 700 includes third transistors (M23*d*1, M23*d*2, M23*d*3, M23*d*4, . . . ) and fourth transistors (M24*d*1, M24*d*2, M24*d*3, M24*d*4, . . . ) connected to data lines (D1-Dm), respectively. The leakage current compensator 700 includes a first leakage current compensation circuit (700-1) connected to odd data lines (D1, D3, . . . ), and a second leakage current compensation circuit 700-2 connected to even data lines (D2, D4, . . . ). The integrator 800 includes an integration circuit. The integrator 800 is connected to the data lines (D1-Dm). The first leakage current compensation circuit 700-1 and the second leakage current compensation circuit 700-2 are connected to the integrator 800.

The fourth switching transistors (M24*d*1, M24*d*3, . . . ) connected to the odd data lines (D1, D3, . . . ) respectively include a gate electrode for receiving third switching control signals (SWC3[1], SWC3[3], . . . ), a first electrode connected to the odd data lines (D1, D3, . . . ), and a second electrode connected to the first leakage current compensation circuit (700-1).

The fourth switching transistors (M24*d*2, M24*d*4, . . . ) connected to the even data lines (D2, D4, . . . ) respectively include a gate electrode for receiving third switching control signals (SWC3[2], SWC3[4], . . . ), a first electrode connected to the even data lines (D2, D4, . . . ), and a second electrode connected to the second leakage current compensation circuit (700-2).

The third transistors (M23*d*1, M23*d*3, . . . ) connected to the odd data line (D1, D3, . . . ) respectively include a gate electrode for receiving second switching control signals (SWC2[1], SWC2[3], . . . ), a first electrode connected to the first leakage current compensation circuit (700-1), and a second electrode connected to the integrator 800.

The third transistors (M23*d*2, M23*d*4, . . . ) connected to the even data lines (D2, D4, . . . ) respectively include a gate electrode for receiving second switching control signals (SWC2[2], SWC2[4], . . . ), a first electrode connected to the second leakage current compensation circuit (700-2), and a second electrode connected to the integrator 800.

Referring to FIG. 6, a configuration of the first leakage current compensation circuit (700-1) and the integrator 800 connected thereto will now be described. The first leakage current compensation circuit (700-1) and the second leakage current compensation circuit (700-2) of FIG. 5 can be formed with the same configuration, so the description of the configuration of the second leakage current compensation circuit 700-2 will be omitted.

The first leakage current compensation circuit (700-1) includes a first transistor (M21), a second transistor (M22), a first capacitor (C21), a first differential amplifier (Amp1), and a bias circuit (Ibias).

The first transistor (M21) includes a gate electrode connected to the second node (N22), a first electrode connected to the high level voltage (VGH), and a second electrode connected to the first node (N21). The first node (N21) is connected to the odd data lines (D1, D3, . . . ).

The second transistor (M22) includes a gate electrode for receiving a first switching control signal (SWC1[1]), a first electrode connected to the output terminal of the first differential amplifier (Amp1), and a second electrode connected to the second node (N22).

The first capacitor (C21) includes a first electrode connected to the high level voltage (VGH), and a second electrode connected to the second node (N22).

The first differential amplifier (Amp1) includes a first input terminal (+) connected to the first node (N21), a second input terminal (−) for receiving a reference voltage (Vset), and an output terminal connected to the first electrode of the second transistor (M22).

The bias circuit (Ibias) is connected between the first node (N21) and the ground, and flows a preselected current amount to the ground from the first node (N21).

The integrator 800 includes a second differential amplifier (Amp2) and a second capacitor (C22). The second differential amplifier (Amp2) includes a first input terminal (+) for receiving the reference voltage (Vset), a second input terminal (−) connected to the second electrode of the third transistor (M23*d*1), and an output terminal for outputting a difference value (OUTj) between the pixel voltage and the reference voltage (Vset). The second capacitor (C12) includes a first electrode connected to the second input terminal (−) of the second differential amplifier (Amp2), and a second electrode connected to the output terminal of the second differential amplifier (Amp2).

An operation of the leakage current compensator 700 and the integrator 800 will now be described, with further reference to FIG. 7.

During a period t1, the odd first switching control signal (SWC1[1]) applied to the first leakage current compensation circuit (700-1), and the third switching control signal (SWC3[1]) applied to the fourth transistor (M24*d*1) connected to the first data line (D1), are applied as a gate-on voltage. The voltage at the second node (N22) of the first leakage current compensation circuit (700-1) becomes a voltage for flowing the leakage current (I_leak) of the first data line (D1) to the first leakage current compensation circuit (700-1). That is, the current amount generated by subtracting the leakage current (I_leak) of the first data line (D1) from the current amount that flows to the ground from the first node (N21) through the bias circuit (Ibias) of the first leakage current compensation circuit (700-1) flows to the first node (N21) through the first transistor (M21). That is, the operation for sensing and storing the leakage current (I_leak) of the first data line (D1) is performed.

During a period t2, the odd first switching control signal (SWC1[1]) applied to the first leakage current compensation circuit (700-1) is applied as a gate-off voltage. The even first switching control signal (SWC1[2]) applied to the second leakage current compensation circuit (700-2) and the third switching control signal (SWC3[2]) applied to the fourth transistor (M24*d*2) connected to the second data line (D2) are applied as a gate-on voltage. The voltage at the second node (N22) of the second leakage current compensation circuit (700-2) allows the leakage current (I_leak) of the second data line (D2) to flow to the second leakage current compensation circuit (700-2). That is, the current amount generated by subtracting the leakage current (I_leak) of the second data line (D2) from the current amount that flows to the ground from the first node (N21) through the bias circuit (Ibias) of the second leakage current compensation circuit (700-2) flows to the first node (N21) through the first transistor (M21). That is, the operation for sensing and storing the leakage current (I_leak) of the second data line (D2) is performed.

In this instance, the third switching control signal (SWC3[1]) applied to the fourth transistor (M24*d*1) connected to the first data line (D1) maintains the gate-on voltage, and the second switching control signal (SWC2[1]) applied to the third transistor (M23*d*1) connected to the first data line (D1) is applied as a gate-on voltage. The sense signal (SEW) with a gate-on voltage is applied to the gate electrode of the sense transistor (M3) included in the pixel (PX) of which degradation will be measured from among the pixels (PX) connected to the first data line (D1). In this instance, a data signal with a preselected voltage is applied to the gate electrode of the driving transistor (M2) included in the pixel (PX). As the sense transistor (M3) of the pixel (PX) is turned on, the pixel current (Ipx) that flows to the organic light emitting diode (OLED) through the driving transistor (M2) is applied to the first data line (D1) through the sense transistor (M3). A measurement current (Isense) that is a sum of the pixel current (Ipx) and the leakage current (I_leak) flows to the first data line (D1). The current that corresponds to the leakage current (I_leak) flows to the first leakage current compensation circuit (700-1), and the current generated by subtracting the leakage current (I_leak) from the measurement current (Isense), that is, the pixel current (Ipx), flows to the integrator 800. The integrator 800 outputs the difference value (OUT) between the pixel voltage that corresponds to the pixel current (Ipx) and the reference voltage (Vset). The degree of degradation of the corresponding pixel (PX) connected to the first data line (D1) can be detected according to the difference value (OUT) between the reference voltage (Vset) and the pixel voltage.

As described, during the period t2 in which the degree of degradation of the pixel (PX) connected to the first data line (D1) is detected, the operation for sensing and storing the leakage current (I_leak) of the second data line (D2) is performed.

During a period t3, the odd first switching control signal (SWC1[1]) applied to the first leakage current compensation circuit (700-1) and the third switching control signal (SWC3[3]) applied to the fourth transistor (M24*d*3) connected to the third data line (D3) are applied as a gate-on voltage. The voltage at the second node (N22) of the first leakage current compensation circuit (700-1) becomes a voltage that allows the leakage current (I_leak) of the third data line (D3) to flow to the first leakage current compensation circuit (700-1). That is, the current amount generated by subtracting the leakage current (I_leak) of the third data line (D3) from the current amount that flows to the ground from the first node (N21) through the bias circuit (Ibias) of the first leakage current compensation circuit 700-1 flows to the first node (N21) through the first transistor (M2)1. That is, the operation for sensing and storing the leakage current (I_leak) of the third data line (D3) is performed.

In this instance, the even first switching control signal (SWC1[2]) applied to the first leakage current compensation circuit (700-1) is applied as a gate-off voltage. The third switching control signal (SWC3[2]) applied to the fourth transistor (M24*d*2) connected to the second data line (D2) maintains the gate-on voltage, and the second switching control signal (SWC2[2]) applied to the third transistor (M23*d*2) connected to the second data line (D2) is applied as a gate-on voltage. The sense signal (SEW) with a gate-on voltage is applied to the gate electrode of the sense transistor (M3) included in the pixel (PX) of which degradation will be measured from among a plurality of pixels (PX) connected to the second data line (D2). In this instance, the data signal with a predselected voltage is applied to the gate electrode of the driving transistor (M2) included in the pixel (PX). As the sense transistor (M3) of the pixel (PX) turned on, the pixel current (Ipx) flowing to the organic light emitting diode (OLED) through the driving transistor (M2) is applied to the second data line (D2) through the sense transistor (M3). A measurement current (Isense) that is a sum of the pixel current (Ipx) and the leakage current (I_leak) flows to the second data line (D2). The current that corresponds to the leakage current (I_leak) flows to the second leakage current compensation circuit (700-2), and the current generated by subtracting the leakage current (I_leak) from the measurement current (Isense), that is, the pixel current (Ipx), flows to the integrator 800. The integrator 800 outputs the difference value (OUT) between the pixel voltage that corresponds to the pixel current (Ipx) and the reference voltage (Vset). The degree of degradation of the corresponding pixel (PX) connected to the second data line (D2) can be detected according to the difference value (OUT) between the reference voltage (Vset) and the pixel voltage.

As described, during the period t3 in which the degree of degradation of the pixel (PX) connected to the second data line (D2) is detected, the operation for sensing and storing the leakage current (I_leak) of the third data line (D3) is performed.

Because the operation for sensing and storing the leakage current of the next data line is performed while the degree of degradation of the pixel connected to one data line is detected, the pixel current with the compensated leakage current can be quickly detected, and the degree of degradation of the pixels can be quickly measured.

According to the above-noted method, the degrees of degradation of pixels from the first data line (D1) to the final data line (Dm) can be detected. When the sense signals (SE[1]-SE[n]) with a gate-on voltage are sequentially applied to a plurality of sense lines, the degradation compensator 600 can detect the degrees of degradation of pixels from the first data line (D1) to the last data line (Dm) corresponding to the sense signal (SE[i]) with a gate-on voltage.

Figure 8:
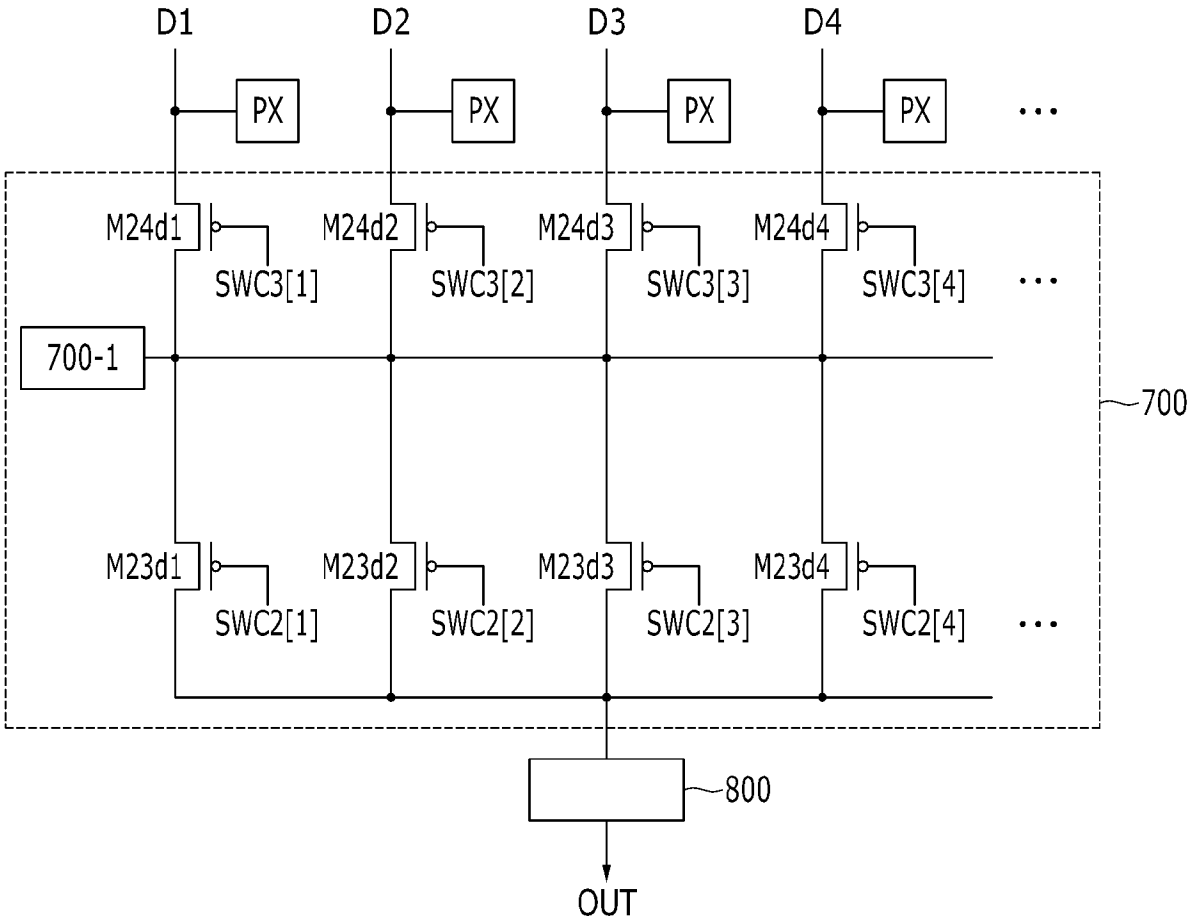
FIG. 8 shows a block diagram of a leakage current compensator and an integrator according to an exemplary embodiment of the present invention.
Figure 9:
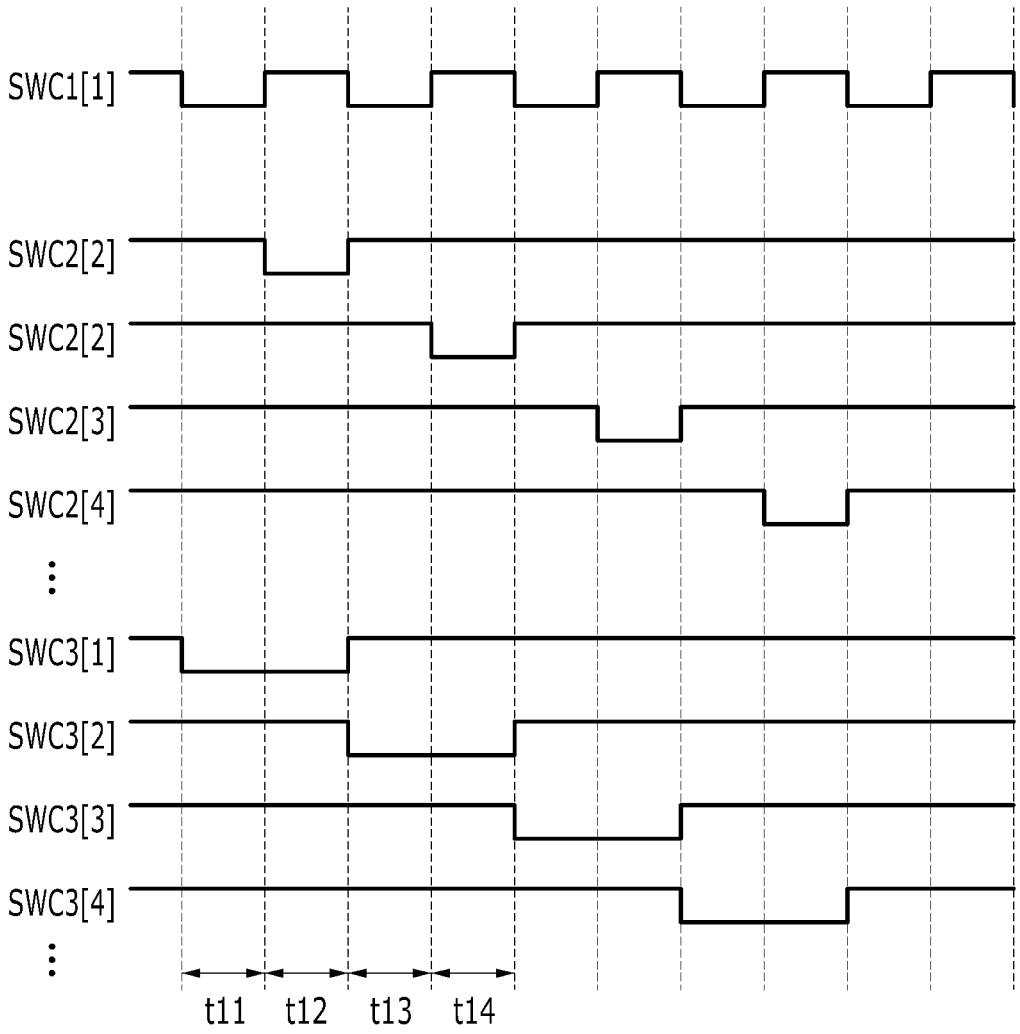
FIG. 9 shows a timing diagram of an operation of a leakage current compensator and an integrator of FIG. 8.

FIG. 8 shows a block diagram of a leakage current compensator and an integrator according to an exemplary embodiment of the present invention. FIG. 9 shows a timing diagram of an operation of a leakage current compensator and an integrator of FIG. 8.

Referring to FIG. 8 and FIG. 9, the leakage current compensator 700 includes third transistors (M23*d*1, M23*d*2, M23*d*3, M23*d*4, . . . ) connected to the data lines (D1-Dm), fourth switching transistors (M24*d*1, M24*d*2, M24*d*3, M24*d*4, . . . ), and a first leakage current compensation circuit (700-1). The integrator 800 includes an integration circuit. The integrator 800 is connected to the data lines (D1-Dm). The first leakage current compensation circuit (700-1) is connected to the integrator 800.

Configurations of the third transistors (M23*d*1, M23*d*2, M23*d*3, M23*d*4, . . . ), the fourth switching transistors (M24*d*1, M24*d*2, M24*d*3, M24*d*4, . . . ), the first leakage current compensation circuit (700-1), and the integrator 800 correspond to the descriptions of FIG. 6, so no detailed descriptions will be provided.

An operation of the leakage current compensator 700 and the integrator 800 will now be described.

During a period t11, the first switching control signal (SWC1[1]) applied to the first leakage current compensation circuit (700-1) and the third switching control signal (SWC3[1]) applied to the fourth transistor (M24*d*1) connected to the first data line (D1) are applied as a gate-on voltage. The voltage at the second node (N22) of the first leakage current compensation circuit (700-1) becomes a voltage that allows the leakage current (I_leak) of the first data line (D1) to flow to the first leakage current compensation circuit (700-1). That is, the current amount generated by subtracting the leakage current (I_leak) of the first data line (D1) from the current amount that flows to the ground from the first node (N21) through the bias circuit (Ibias) of the first leakage current compensation circuit (700-1) flows to the first node (N21) through the first transistor (M21). That is, the operation for sensing and storing the leakage current (I_leak) of the first data line (D1) is performed.

During a period t12, the first switching control signal (SWC1[1]) applied to the first leakage current compensation circuit 700-1 is applied as a gate-off voltage. The third switching control signal (SWC3[1]) applied to the fourth transistor (M24*d*1) connected to the first data line (D1) maintains the gate-on voltage. The second switching control signal (SWC2[1]) applied to the third transistor (M23*d*1) connected to the first data line (D1) is applied as a gate-on voltage. The sense signal (SEW) with a gate-on voltage is applied to the gate electrode of the sense transistor (M3) included in the pixel (PX) of which degradation will be measured from the pixels (PX) connected to the first data line (D1). Here, a data signal with a predetermined voltage is applied to the gate electrode of the driving transistor (M2) included in the pixel (PX). As the sense transistor (M3) of the pixel (PX) is turned on, a pixel current (Ipx) flowing to the organic light emitting diode (OLED) through the driving transistor (M2) is applied to the first data line (D1) through the sense transistor (M3). A measurement current (Isense) that is a summation of the pixel current (Ipx) and the leakage current (I_leak) is applied to the first data line (D1). The current that corresponds to the leakage current (I_leak) flows to the first is leakage current compensation circuit (700-1), and the current generated by subtracting the leakage current (I_leak) from the measurement current (Isense), that is, the pixel current (Ipx), flows to the integrator 800. The integrator 800 outputs the difference value (OUT) between the pixel voltage that corresponds to the pixel current (Ipx) and the reference voltage (Vset). The degree of degradation of the corresponding pixel (PX) connected to the first data line (D1) can be detected according to the difference value (OUT) between the reference voltage (Vset) and the pixel voltage.

During a period t13, the operation for sensing and storing the leakage current (I_leak) of the second data line (D2) is performed. The operation is performed on the second data line (D2) in a manner similar to the operation during the period t11.

During a period t14, a degree of degradation of the corresponding pixel (PX) connected to the second data line (D2) is detected. The detection is performed on the second data line (D2) in a manner similar to the operation during the period t12.

By the above-described method, the degrees of degradation of pixels from the first data line (D1) to the last data line (Dm) are detected. When the sense signals (SE[1]-SE[n]) with a gate-on voltage are sequentially applied to the sense lines, the degradation compensator 600 can detect the degrees of degradation of pixels from the first data line (D1) to the last data line (Dm) corresponding to the sense signal (SEW) with a gate-on voltage.

The above-noted transistors can be oxide thin film transistors (oxide TFT) with a semiconductor layer made of an oxide semiconductor.

The oxide semiconductor includes one of an oxide that includes titanium (Ti), hafnium (Hf), zirconium (Zr), aluminum (Al), tantalum (Ta), germanium (Ge), zinc (Zn), gallium (Ga), tin (Sn), or indium (In), and complex oxides thereof such as zinc oxide (ZnO), indium-gallium-zinc oxide (In-$GaZnO_4$), indium-zinc oxide (Zn—In—O), zinc-tin oxide (Zn—Sn—O), indium-gallium oxide (In—Ga—O), indium-tin oxide (In—Sn—O), indium-zirconium oxide (In—Zr—O), indium-zirconium-zinc oxide (In—Zr—Zn—O), indium-zirconium-tin oxide (In—Zr—Sn—O), indium-zirconium-gallium oxide (In—Zr—Ga—O), indium-aluminum oxide (In—Al—O), indium-zinc-aluminum oxide (In—Zn—Al—O), indium-tin-aluminum oxide (In—Sn—Al—O), indium-aluminum-gallium oxide (In—Al—Ga—O), indium-tantalum oxide (In—Ta—O), indium-tantalum-zinc oxide (In—Ta—Zn—O), indium-tantalum-tin oxide (In—Ta—Sn—O), indium-tantalum-gallium oxide (In—Ta—Ga—O), indium-germanium oxide (In—Ge—O), indium-germanium-zinc oxide (In—Ge—Zn—O), indium-germanium-tin oxide (In—Ge—Sn—O), indium-germanium-gallium oxide (In—Ge—Ga—O), titanium-indium-zinc oxide (Ti—In—Zn—O), and hafnium-indium-zinc oxide (Hf—In—Zn—O).

The semiconductor layer includes a channel region that is not doped with impurities, and a source region and drain region doped with impurities on respective sides of the channel region. Here, these impurities vary depending on the type of the thin film transistor, and may be an N-type impurity or a P-type impurity.

When the semiconductor layer is made of the oxide semiconductor, an extra protection layer may be added in order to protect the oxide semiconductor that is vulnerable to the external environment such as being exposed to a high temperature.

The leakage current is compensated to measure an accurate pixel current. Accordingly, degradation of the pixel can be accurately detected. Furthermore, the pixel current with a compensated leakage current for a plurality of pixels can be quickly detected.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A display device comprising:

pixels;

data lines connected to the pixels;

a leakage current compensator connected to one of the data lines, the leakage current compensator configured to store a voltage that corresponds to a leakage current that flows to the one data line, and to transmit the leakage current to ground from the at least one data line, according to a voltage that corresponds to the leakage current; and an integrator connected to the leakage current compensator, the integrator configured to receive a pixel current generated by subtracting the leakage current from a measurement current that is transmitted to the at least one data line, and to output a difference value between a pixel voltage that corresponds to the pixel current and a reference voltage.

2. The display device of claim 1, wherein the leakage current compensator comprises a leakage current compensation circuit, the leakage current compensation circuit comprising:

a first transistor comprising:

a first electrode connected to a first node and the data line;

a gate electrode connected to a second node; and a second electrode connected to a high level voltage;

a first differential amplifier comprising:

a first input terminal connected to the first node; and a second input terminal configured to receive the reference voltage;

a second transistor comprising:

a gate electrode configured to receive a first switching control signal;

a first electrode connected to an output terminal of the differential amplifier; and a second electrode connected to the second node;

a first capacitor comprising:

a first electrode connected to the high level voltage; and a second electrode connected to the second node; and a bias circuit connected between the first node and the ground, and configured to transmit a current to ground from the first node.

3. The display device of claim 2, wherein the leakage current compensation circuit further comprises a third transistor, the third transistor comprising:

a gate electrode configured to receive a second switching control signal;

a first electrode connected to the first node; and a second electrode connected to the integrator.

4. The display device of claim 3, wherein the integrator comprises an integration circuit, the integration circuit comprising:

a second differential amplifier comprising:

a first input terminal configured to receive the reference voltage;

a second input terminal connected to a second electrode of the third transistor; and an output terminal; and a second capacitor comprising:

a first electrode connected to a second input terminal of the second differential amplifier; and a second electrode connected to an output terminal of the second differential amplifier.

5. The display device of claim 4, wherein:

the display device comprises a number of leakage current compensation circuits and integration circuits that is equal to the number of data lines; and the leakage current compensation circuit and the integration circuit are connected to the data lines, respectively.

6. The display device of claim 2, wherein the leakage current compensator further comprises:

a third transistor comprising:

a gate electrode configured to receive a second switching control signal;

a first electrode connected to the first node; and a second electrode connected to the integrator; and a fourth transistor comprising:

a gate electrode configured to receive a third switching control signal;

a first electrode connected to the data line; and a second electrode connected to the first node.

7. The display device of claim 6, wherein storing a voltage that corresponds to a leakage current of the data line in the first capacitor, and outputting a difference value between a pixel voltage that corresponds to a pixel current generated by subtracting a leakage current of the data line from a measurement current that flows to the data line and a reference voltage, are sequentially performed on the data lines.

8. The display device of claim 2, wherein the leakage current compensation circuit comprises:

a first leakage current compensation circuit connected to an odd data line; and a second leakage current compensation circuit connected to an even data line.

9. The display device of claim 8, wherein the leakage current compensator further comprises third transistors and fourth transistors connected to the data lines, respectively.

10. The display device of claim 9, wherein, when a voltage that corresponds to a leakage current of the odd data line is stored in the first capacitor included in the first leakage current compensation circuit, a difference value between a pixel voltage that corresponds to a pixel current, which is generated by subtracting a leakage current of the even data line from a measurement current that flows to the even data line, and a reference voltage is output.

11. The display device of claim 10, wherein, when a voltage that corresponds to a leakage current of the even data line is stored in the first capacitor included in the second leakage current compensation circuit, a difference value between a pixel voltage that corresponds to a pixel current, which is generated by subtracting a leakage current of the odd data line from a measurement current that flows to the odd data line, and the reference voltage is output.

12. The display device of claim 1, wherein:

the leakage current compensator comprises:

a first leakage current compensation circuit connected to an odd data line; and a second leakage current compensation circuit connected to an even data line; and each of the first and second leakage current compensation circuits comprises:

a first transistor comprising:

a first electrode connected to a first node and the data line;

a gate electrode connected to a second node; and a second electrode connected to a high level voltage;

a first differential amplifier comprising:

a first input terminal connected to the first node; and a second input terminal configured to receive the reference voltage;

a second transistor comprising:

a gate electrode configured to receive a first switching control signal;

a first electrode connected to an output terminal of the differential amplifier; and a second electrode connected to the second node;

a first capacitor comprising:

a first electrode connected to the high level voltage; and a second electrode connected to the second node; and a bias circuit connected between the first node and the ground, and configured to transmit a current to ground from the first node.

13. The display device of claim 12, wherein each of the first and second leakage current compensators further comprises third transistors and fourth transistors connected to the odd and even data lines, respectively.

14. A method for driving a display device comprising pixels and data lines connected to the pixels, the method comprising:

storing a voltage that corresponds to a leakage current that flows to one of the data lines;

transmitting the leakage current to ground from the data line according to a voltage that corresponds to the leakage current;

transmitting a measurement current to the data line;

receiving a pixel current generated by subtracting the leakage current from the measurement current; and outputting a difference value between a pixel voltage that corresponds to the pixel current and a reference voltage.

15. The method of claim 14, wherein the storing of a voltage that corresponds to a leakage current that flows to a data line comprises applying a difference value between a voltage at a first node connected to the data line and the reference voltage to a second node.

16. The method of claim 15, wherein the transmitting of the leakage current to ground from the data line according to a voltage that corresponds to the leakage current comprises:

transmitting a current to the first node from a high level voltage according to a voltage at the second node; and transmitting a current to ground from the first node.

17. The method of claim 16, wherein the outputting of a difference value between a pixel voltage that corresponds to the pixel current and a reference voltage comprises outputting a difference value between the pixel voltage and the reference voltage by using a differential amplifier, the differential amplifier comprising:

a first input terminal for receiving the reference voltage; and a second input terminal for receiving the pixel voltage.

18. The method of claim 14, wherein the storing of a voltage that corresponds to a leakage current that flows to the data line, the flowing of the leakage current to ground from the data line according to a voltage that corresponds to the leakage current, the flowing of a measurement current to the data line, the receiving of a pixel current generated by subtracting the leakage current from the measurement current, and the outputting of a difference value between a pixel voltage that corresponds to the pixel current and a reference voltage are sequentially performed to the data line at a pixel row.

19. A method for driving a display device comprising pixels and data lines connected to the pixels, comprising:

outputting a difference value between a pixel voltage that corresponds to a pixel current generated by subtracting a leakage current of an even data line from a measurement current that flows to the even data line and a reference voltage when a voltage that corresponds to a leakage current that flows to an odd data line is stored; and outputting a difference value between a pixel voltage that corresponds to a pixel current generated by subtracting a leakage current of the odd data line from a measurement current that flows to the odd data line and the reference voltage when a voltage that corresponds to a leakage current of the even data line is stored.

* * * * *